US005437294A

United States Patent [19]

Ebbets, III et al.

[11] Patent Number: 5,437,294

[45] Date of Patent: Aug. 1, 1995

[54] COMPACT WITH ROTATABLE PANEL IN BASE AND/OR COVER

[75] Inventors: John A. Ebbets, III, Rockville Centre, N.Y.; Dennis J. Anderson, Randolph, N.J.

[73] Assignee: LIR-USA Manufacturing Co., Inc., Yaphank, N.Y.

[21] Appl. No.: 27,207

[22] Filed: Mar. 4, 1993

[51] Int. Cl.[6] ..... A45D 42/02; B65D 69/00

[52] U.S. Cl. ..... 132/304; 132/296; 206/581; 206/823

[58] Field of Search ..... 132/295, 296, 301, 304; 206/581, 823

[56] References Cited

U.S. PATENT DOCUMENTS

| | | | |
|---|---|---|---|
| 1,464,355 | 8/1923 | Eppenstein | 132/296 |
| 1,489,788 | 4/1924 | Reid | 132/296 |
| 1,511,525 | 10/1924 | Saart | 132/296 |
| 1,518,594 | 12/1924 | Marble . | |
| 1,525,943 | 2/1925 | Marble . | |
| 1,583,120 | 5/1926 | Brenner | 132/296 |
| 1,682,534 | 8/1928 | Martinat . | |
| 1,732,866 | 10/1929 | Stiriss | 132/296 |
| 1,838,697 | 12/1931 | McAtree . | |
| 1,957,157 | 5/1934 | Bosch . | |
| 2,224,995 | 12/1940 | Vogel | 132/304 |
| 2,570,314 | 10/1951 | Brand | 132/304 |
| 3,591,792 | 7/1971 | Soltan . | |
| 3,844,410 | 10/1974 | Cook . | |
| 4,589,430 | 5/1986 | Sussman . | |
| 4,684,017 | 8/1987 | Watanabe et al. | 206/581 |
| 4,826,014 | 5/1989 | Schefer . | |
| 4,840,288 | 6/1989 | Landerman et al. . | |
| 4,863,034 | 9/1989 | Contreras, Sr. . | |
| 5,078,159 | 1/1992 | Yuhara . | |
| 5,092,354 | 3/1992 | Pacelli, Jr. . | |
| 5,161,556 | 11/1992 | Audebourg et al. | 132/296 |

FOREIGN PATENT DOCUMENTS

| | | | |
|---|---|---|---|
| 149501 | 12/1936 | Austria | 132/304 |
| 716847 | 12/1931 | France . | |
| 848868 | 11/1939 | France . | |
| 1082752 | 1/1955 | France | 132/304 |
| 0753647 | 7/1956 | United Kingdom | 132/301 |

*Primary Examiner*—John G. Weiss
*Attorney, Agent, or Firm*—Cooper & Dunham

[57] ABSTRACT

A compact for containing material (e.g., cosmetics), having a base and/or a cover constituted of a peripheral frame and a central panel mounted therein for rotation between inwardly and outwardly facing positions. In a base so constituted, the panel is a material-holding tray. In a cover so constituted, at least one side of the panel may bear a mirror.

11 Claims, 7 Drawing Sheets

FIG. 4
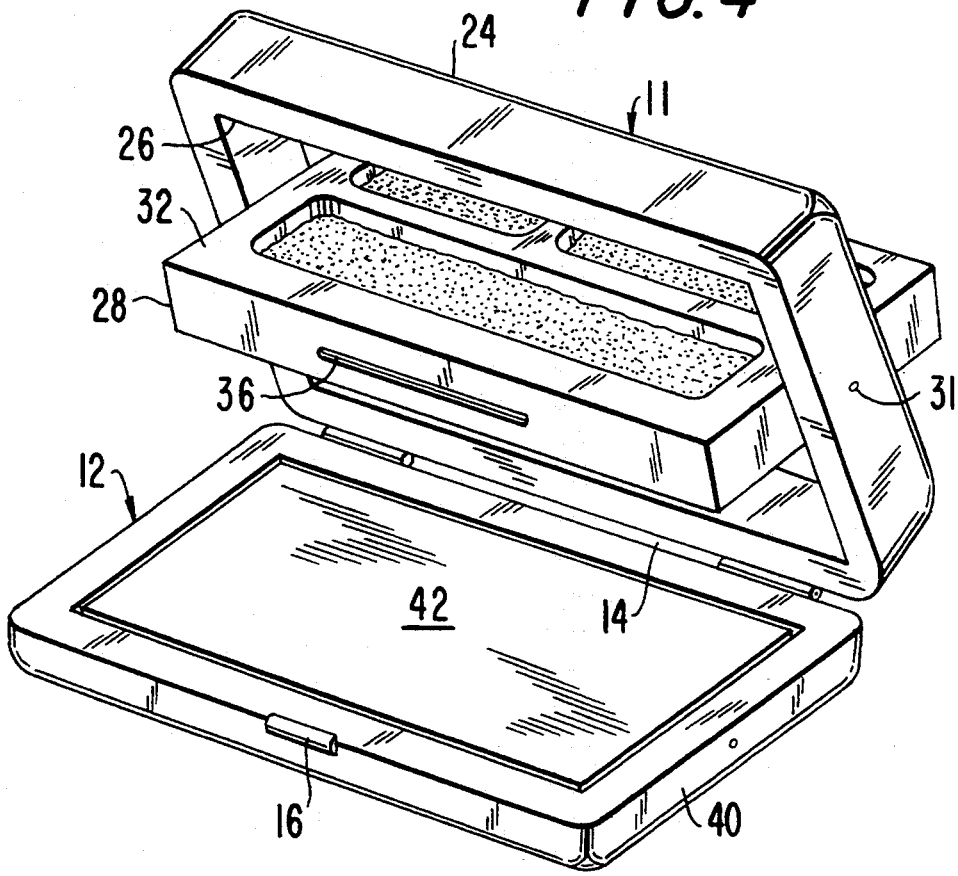
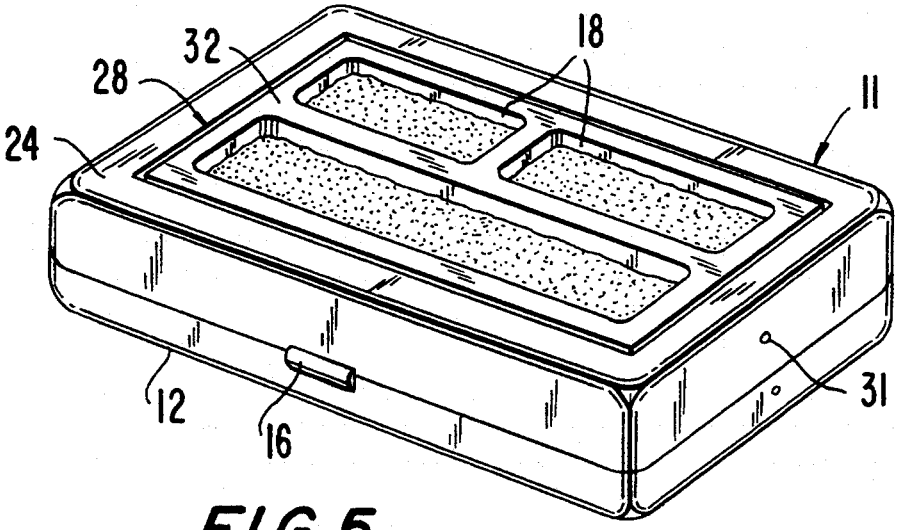
FIG. 5

COMPACT WITH ROTATABLE PANEL IN BASE AND/OR COVER

BACKGROUND OF THE INVENTION

This invention relates to compacts, and in an important specific sense more particularly to compacts for containing cosmetics for application by an end user.

For purposes of illustration, the invention will be described herein as embodied in compacts for cosmetics, it being understood, however, that its broader aspects the invention is not limited thereto but may be embodied in compacts for containing other types of materials as well.

Many cosmetics materials, including face powders, foundations, eye shadows, blushes, and some lipsticks and mascaras, are commonly placed (for retail sale and subsequent end use) in containers known as compacts. A conventional compact includes a base formed as a tray with one or more upwardly open recesses for holding the cosmetic material in compressed or like stable condition, and a cover for overlying the base and enclosing the tray to prevent the contents from drying out, becoming contaminated, spilling, or soiling outside objects. One or more brushes, pads or other implements for applying the cosmetics may also be placed within the compact between the base and cover.

In these conventional compacts, the base and cover are typically molded of plastic or formed of metal, and are hinged together in clamshell fashion along one side of the compact, a manually operably latch being provided on the other side to hold them in closed position. The compact is dimensioned to be held in the hand, and may be square, rectangular, oval, circular, or of other regular or irregular shape. To apply the contained cosmetics, the user opens the compact, draws an applying implement (or a finger) across the cosmetic material held in a recess of the base tray to pick up some of the material, and conveys it on the implement to the appropriate facial area.

It is frequently desirable to package a compact in a manner enabling retail customers to view the contained cosmetic material at the point of sale without exposing the material to contamination such as can occur if a compact is opened at a store by a prospective purchaser. Accordingly, the compact may be sealed in a transparent plastic film, e.g., in a blister package, with the cover opened to lie flat with the base so that the contents of the compact are clearly visible through the blister film. A problem with this type of packaging, however, is that the area of the package must ordinarily be at least twice the area of the closed compact, because the base and cover lie open at 180°, or approximately at 180°, to each other; hence the packages occupy undesirably large amounts of shelf or display space.

Expedients heretofore proposed to reduce the area occupied by compacts in blister-package or like displays have involved the provision of special articulated hinges connecting the cover and base to enable the cover to turn 360° into a position underlying the base. These expedients are more or less structurally complicated, adding to manufacturing cost and complexity, and may present difficulties in manipulation for the end user.

SUMMARY OF THE INVENTION

The present invention broadly contemplates the provision of a compact including a base member, a cover member, and means for connecting the base and cover members together in a manner permitting relative movement of the members to open and close the compact, wherein at least one of the members comprises a frame, exposed to the exterior of the compact when the compact is closed, defining and completely laterally surrounding at least one through opening; at least one panel, having opposed major faces and shaped and dimensioned to be received within the frame opening in substantially flush relation to the frame; and means for pivotally mounting the panel to the frame for rotation within the opening, relative to the frame, about an axis extending across the opening, into and out of at least one position in which the panel lies substantially flush with the frame and one of the major faces of the panel is exposed to the exterior of the compact when the compact is closed.

Further in accordance with the invention, the member constituted of the frame and panel also includes means for retaining the panel in its last-mentioned position relative to the frame. This retaining means, for example, may comprise a projection on either the frame or the panel and a portion of the other of the frame and panel shaped and positioned to engage the projection when the panel is in the aforesaid position relative to the frame.

When the base member comprises a frame and panel as described above, one of the major faces of the panel is formed as a tray for holding material to be contained in the compact, e.g., cosmetic material. When the cover member comprises such a frame and panel, at least one of the major faces of the panel may bear a mirror. Such a base and cover may be included in the same compact.

As a particular feature of the invention, in currently preferred and advantageous embodiments, the panel is shaped and dimensioned to be rotatable, relative to the frame, through at least 180°, between two positions in which the opposite major faces of the panel are respectively exposed to the exterior of the compact when the compact is closed, the panel lying substantially flush with the frame in each of these positions; and wherein the mounting means pivotally mounts the panel for such rotation (about the aforementioned axis) between these two positions. In such case, the retaining means preferably comprises means for releasably holding the panel in each of the two positions relative to the frame.

In embodiments of this preferred type, and wherein the base member comprises a frame and panel as aforesaid with one of the major faces of the panel formed as a tray for holding material, the tray is respectively oriented toward the interior of the compact and exposed to the exterior of the compact in the two aforesaid positions of the panel, the compact being closable when the panel is in either of the two positions. Consequently, the compact may be arranged for blister packaging with the contained material (e.g., cosmetics) exposed to view, and as thus arranged, it occupies no greater area than the area of the base alone, i.e., the area of the compact when closed.

Stated with reference to compacts for cosmetics, this arrangement also facilitates initial filling of the compact by the cosmetics manufacturer. After the package is opened, the purchaser can simply rotate the base panel into the position in which the tray faces inwardly, so that the contents will be protected by the cover, and can thereafter use the compact in the same manner as a conventional compact, the tray being held in the latter position by the retaining means. The structure is simple, sturdy, and easy to manufacture and use.

When the cover comprises a frame and rotating panel in accordance with the invention, two different mirrors (e.g. normal and enlarging mirrors) can be respectively mounted on opposite sides of the cover panel, for selective employment by the user as desired.

Further features and advantages of the invention will be apparent from the detailed description hereinbelow set forth, together with the accompanying drawings.

BRIEF DESCRIPTION OF THE DRAWINGS

FIG. 4 is a perspective view of the compact of FIG. 1, showing the compact inverted and open with the base panel at an intermediate point of rotation between the positions of FIGS. 2 and 5;

FIG. 5 is a perspective view of the same compact, inverted and closed, showing the base panel in a second position, arranged for display of the contained cosmetics;

DETAILED DESCRIPTION

Figure 1:
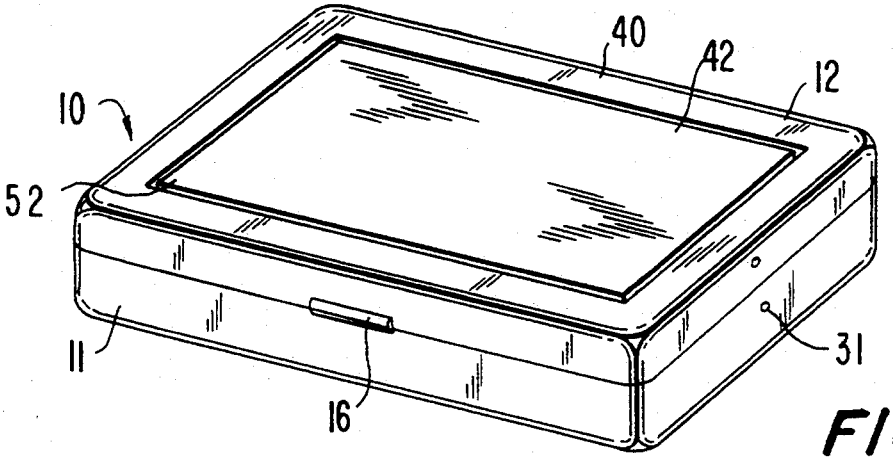
FIG. 1 is a perspective view, from above, of a compact embodying the present invention in a particular form, the compact being closed.

In FIGS. 1–9, the invention is illustrated as embodied in a compact 10 of generally rectangular plan configuration, dimensioned to be held in a user's hand, for holding a selection of cosmetic materials for application to the face. The compact 10 includes a base member 11 and a cover member 12, of identical rectangular plan configuration (though they may differ in depth), interconnected along one long side by a hinge 14 and provided on the opposite side with a latch 16 for holding the cover member in closed position on the base member. The hinge and latch may be entirely conventional and are therefore indicated only schematically in the drawings.

The base and cover members are substantially rigid and are self-sustaining in shape. They, as well as other elements of the compact, may be fabricated in a generally conventional manner of materials conventionally used for such purposes. For instance, they may be molded of a suitable plastic or formed of a suitable metal, with a metal pin (not shown) employed in the hinge and reflectively coated glass, plastic or other reflective element used for the mirror.

Figure 3:
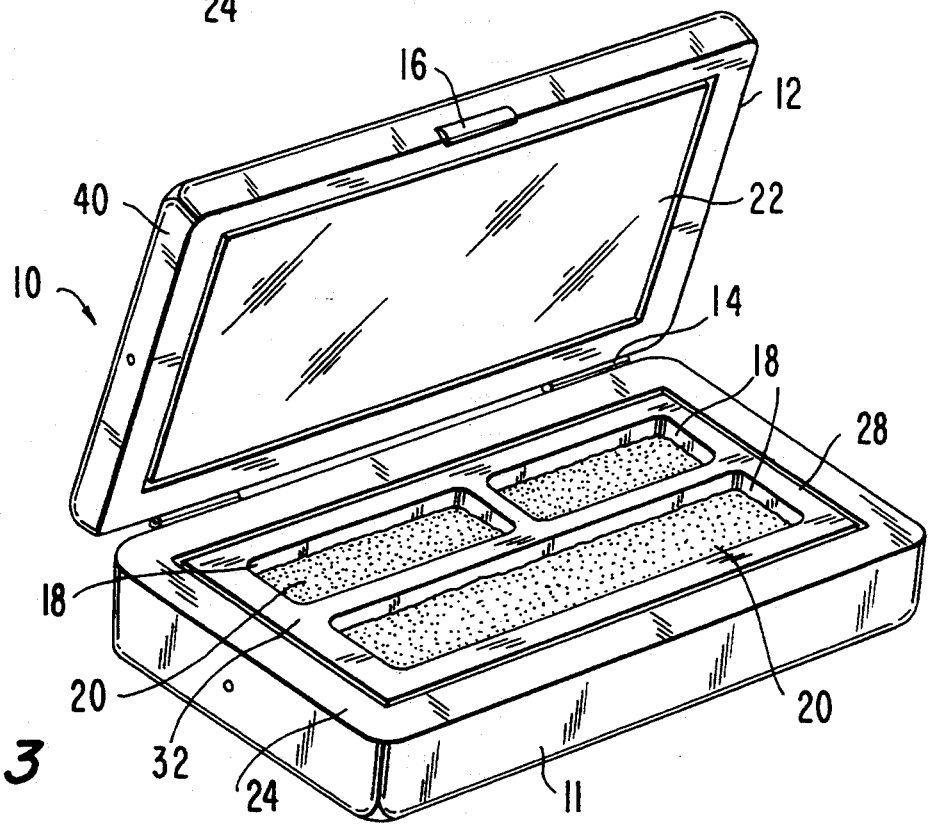
FIG. 3 is a perspective view of the compact of FIG. 1, showing the compact open with the base panel in the first position, arranged for application of the contained cosmetics.

In common with conventional compacts, and as best seen in FIG. 3, the interior of the base member is formed as a tray having (in the present instance) plural upwardly open recesses or compartments 18 for holding quantities of compressed powdered cosmetics 20, e.g. of different colors; the number of such compartments, and the nature of the cosmetics contained therein, are immaterial to the invention. A mirror 22 may be mounted in the cover member 12.

Figure 2:
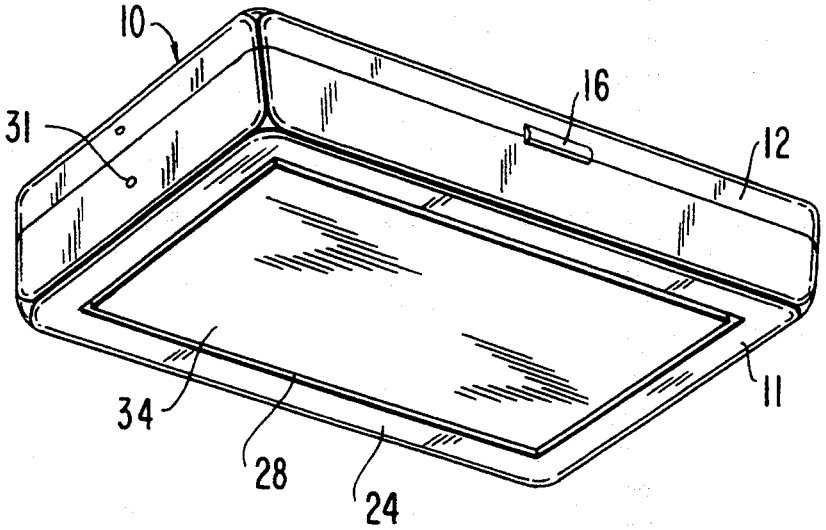
FIG. 2 is a similar perspective view, but from below, of the compact of FIG. 1, again closed, showing the base panel in a first position.

Also in common with conventional compacts, and as best seen in FIGS. 1 and 2, the compact is ordinarily carried by the user with the cover member closed and latched over the base member so as to enclose the contained cosmetics. For applying the cosmetics, the compact is opened as shown in FIG. 3, to expose the cosmetic-holding recesses and mirror; the user then removes a portion of a selected cosmetic with a pad, brush or other implement, or a finger, and applies it to her face while observing her reflection in the mirror 22. To facilitate such operation, the hinge should permit the cover to move, in opening, through an angle of at least about 90° relative to the base; commonly, the cover is movable to a full-open position at an angle of 180° relative to the base.

As a particular feature of the invention, in the embodiment of FIGS. 1–9, the base member 11 is not constituted as a single, integral unit, but instead comprises a rectangular peripheral frame 24 defining, and completely laterally surrounding, a through opening 26 (FIG. 4); a central platform or panel 28, shaped and dimensioned to be received within the opening 26; and means shown as a pair of pivot pins 30 (FIGS. 6 and 8) for pivotally mounting the panel 28 to the frame 24 for rotation within the opening 26, relative to the frame, about an axis extending across the opening. The term "through opening" as used herein means an opening which extends entirely through the base from the exterior to the interior of the compact.

The panel 28 and frame 24 may, as stated, be molded plastic or formed metal elements, and the pivot pins may simply be inserted into suitable bores 31 opening through the short sides of the frame, and into corresponding bores in the panel. At their outer ends, the bores may be sealed or plugged in any suitable manner to retain the pins in place. Other pivoting means, for example rounded bumps and mating recesses respectively formed in facing side edges of the frame and panel, may be employed in place of the pins.

The opening 26 is rectangular in plan, and the panel 28 is also rectangular in plan, being shaped and dimensioned to be received within the opening in substantially flush relation to the frame and, as thus received, to fill substantially the entire opening. The panel has two opposed major faces 32 and 34; of these, the face 32 is formed as the tray of the base, i.e., it contains the aforementioned cosmetics-holding recesses 18, while the face 34 is shown as smooth although it may be provided with suitable decorative ornamentation if desired.

The rectangular opening 26 and panel 28 are bilaterally symmetrical in plan about each of two (long and short) axes, and are so disposed that the panel axes of symmetry respectively coincide with the corresponding axes of the opening. The pivot pins 30 are positioned on one of the axes of symmetry of the panel and opening, viz. the long axis of symmetry in the illustrated embodiment (although the short axis could equally well be used), so that the axis of rotation of the panel within the opening coincides with the common long axis of symmetry of the opening and panel. In addition, the shapes and spacing of the long edges of the panel and opening are selected to provide sufficient clearance for rotation of the panel about the latter axis through at least 180°.

Owing to this clearance and to the coincident bilateral symmetry of the opening and panel, as well as to the positioning of the pivot pins for rotation of the panel about an axis of symmetry and the dimensioning of the panel to lie in flush relation to the frame, the panel is rotatable between two opposite positions in both of which it lies flush with the frame 24; and the base and cover members of the compact are fully closable when the panel is in either of these opposite "flush" positions. In the first of the two opposite flush positions of the panel (FIGS. 2, 3, 8 and 9), the tray face 32 of the panel is oriented toward the interior of the compact and the other panel face 34 is exposed to the exterior of the compact. In the second of the two flush positions (FIGS. 5, 6 and 7), the tray face 32 is exposed to the exterior of the compact. An intermediate point in the rotation of panel 24 between the two opposite flush positions is illustrated in FIG. 4.

Figure 7:
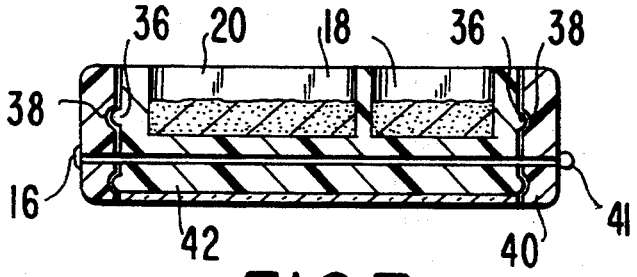
FIG. 7 is another elevational sectional view of the compact with the elements oriented as in FIG. 5, taken along the short axis of symmetry of the base panel.
Figure 8:
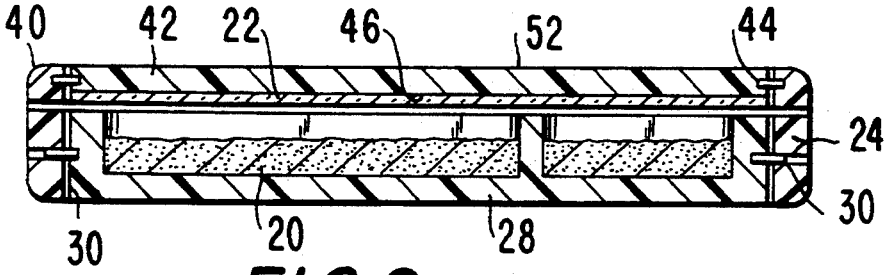
FIG. 8 is an elevational sectional view of the compact with the elements oriented as in FIG. 1, taken along the long axis of symmetry of the base panel.
Figure 9:
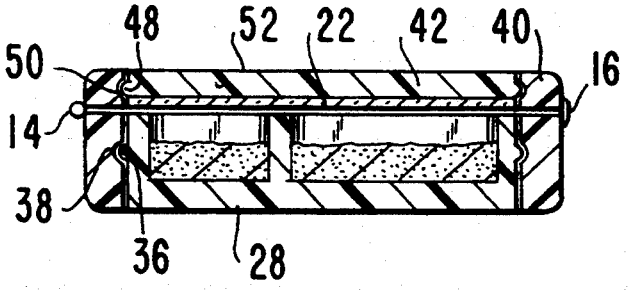
FIG. 9 is another elevational sectional view of the compact with the elements oriented as in FIG. 1, taken along the short axis of symmetry of the base panel.

Means, shown in FIGS. 4, 7 and 9 as a rounded detent projection or bead 36 formed on each long side edge of the panel and a mating dimple or depression 38 formed in each long side edge of the frame facing the opening, are provided for releasably retaining the panel in each of the two flush positions relative to the frame. As the panel moves into either of the two flush positions, under manual pressure, the projections 36 on both long sides of the panel are received in the depressions of the frame, holding the panel against rotation in either direction. The projections can be forced out of the depressions by manual pressure, however, to enable the panel to be rotated to the other position. As hereinafter further explained, the projections and depressions can be shaped either to permit full 360° rotation of the panel in the frame, or to restrict rotation to 180° including the two flush positions.

For transport of the compact in a user's handbag or pocket, as well as for application of cosmetics, the panel 28 is disposed in the first flush position, in which the tray face 32 is oriented toward the interior of the panel. The contained cosmetics are thereby fully enclosed between the base and cover members when the cover is shut as shown in FIG. 2, and are appropriately disposed for application (with concurrent use of the mirror 22) when the compact is open as shown in FIG. 3. For initial filling by a cosmetics manufacturer and for retail display, however, the panel is disposed in the second flush position, in which the tray face 32 is exposed to the exterior of the compact so that the recesses 18 are accessible for filling, and the contained cosmetics are visible for viewing by a prospective purchaser, even though the compact is fully closed, as shown in FIG. 5.

To move the panel 28 between the two flush positions, the compact is opened as shown in FIG. 4, and manual pressure is applied to the panel (preferably against the plain face 34, near one long edge of the panel) to dislodge the projections 36 from their mating surface and to cause the panel to rotate on the pivot pins within the frame, through the intermediate (FIG. 4) position and into the other of the two flush positions.

Figure 6:
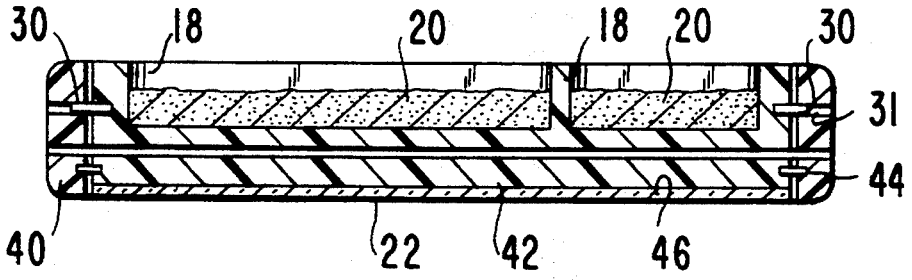
FIG. 6 is an elevational sectional view of the compact with the elements oriented as in FIG. 5, taken along the long axis of symmetry of the base panel.

The cover member of the compact 10 may be a wholly conventional one-piece cover or lid. Alternatively, and as further shown in FIGS. 1–9, the cover member 12 (like the base member 11) may comprise a peripheral frame 40 defining a rectangular through opening; a rectangular central panel 42 having opposed major faces dimensioned to lie flush within, and substantially filling, this opening; and means such as pivot pins 44 for mounting the panel 42 to the frame 40 for rotation about a common axis of symmetry of the panel and opening between opposite positions, in each of which the panel lies flush with the frame. The mirror 22 may be mounted on one major face 46 of the panel 42, so that rotation of the panel selectively orients the mirror toward the interior of the compact (FIGS. 3, 8 and 9) or exposes the mirror to the exterior (FIGS. 6 and 7). Detent means 48 and 50, similar to the projections 36 of the base panel and the associated base frame depressions 38, may be provided on the cover panel and frame to releasably retain the panel 42 in either of the two flush positions. If desired, a second mirror (not shown) may be mounted on the major face 52 of panel 42 opposite face 46; for example, two mirrors respectively providing normal and magnified reflection may be mounted on the opposite faces of the cover panel, the rotatability of the panel enabling the user selectively to locate either mirror in the inwardly-facing position (of mirror 22 in FIG. 3) for use.

Figure 10:
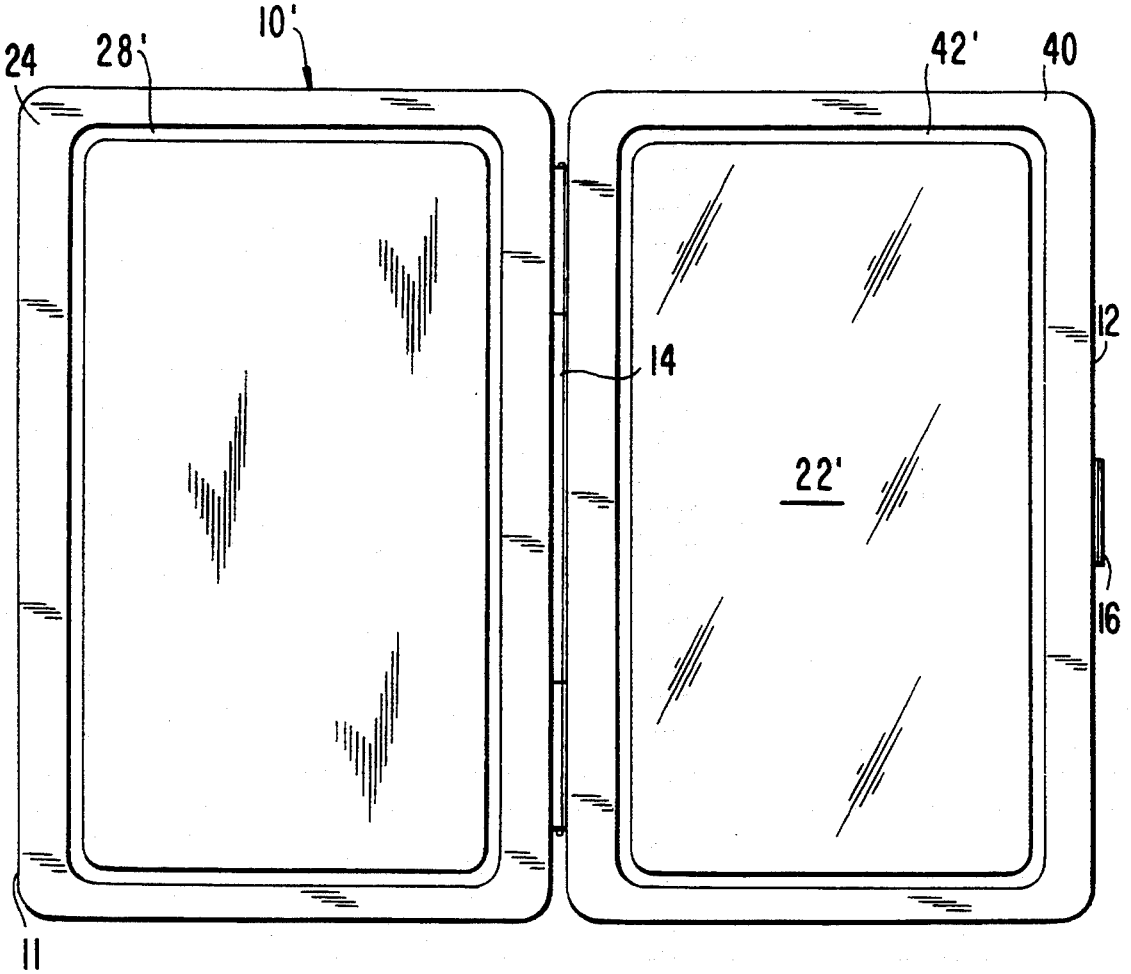
FIG. 10 is a plan view of another similar compact embodying the invention, with the cover and base opened 180°.
Figure 11:
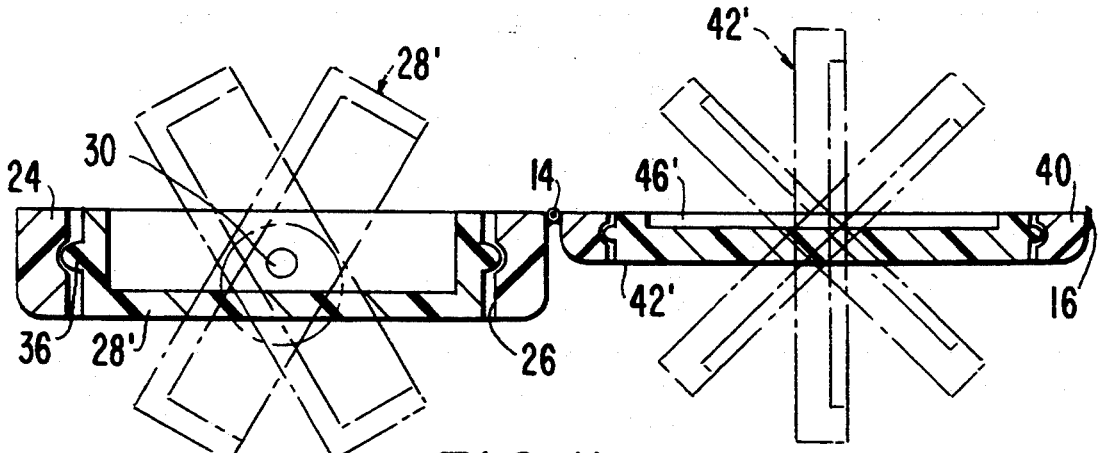
FIG. 11 is a sectional view taken along the line 11—11 of FIG. 10.

The embodiment of the invention shown in FIGS. 10 and 11 is generally similar to that of FIGS. 1–9, and like elements are accordingly indicated by like reference numerals. In this embodiment, however, the base panel 28' of the compact 10' is formed as a tray having only a single compartment, e.g. for face powder; a suitable applicator implement such as a pad or puff may overlie the powder in the tray. Also in this embodiment, one major face 46' of the cover panel 42' is recessed to receive the mirror 22'. The rotation of both panels 28' and 42' is illustrated in broken lines in the sectional view of FIG. 11.

Figure 12A:
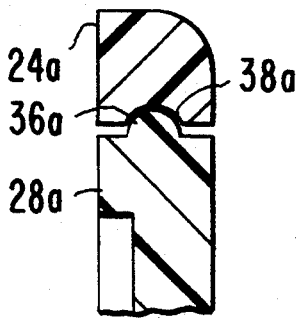
FIGS. 12A, 12B and 12C are enlarged fragmentary sectional views of various illustrative or exemplary types of retaining means for the compact of FIG. 10.
Figure 12B:
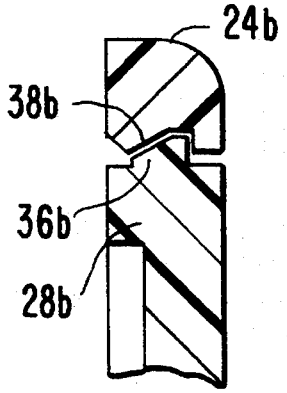
Figure 12C:
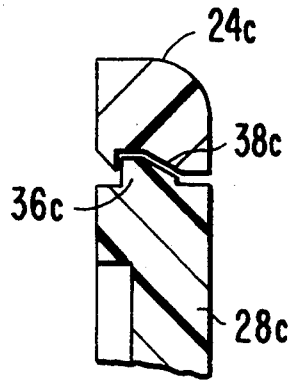

FIGS. 12A, 12B and 12C show alternative forms of retaining means that may be used in the described embodiments of the invention, it being understood that these are merely illustrative or exemplary of suitable retaining means, and that the invention is not limited in its broader aspects thereto. The rounded detent projection **36*a* and depression 38*a* of FIG. 12A enable full 360° rotation of the panel 28*a* about its pivot axis relative to the frame 24*a*, because the detent projection can be forced out of the depression in either rotational direction (arrow 60) by manual pressure on the panel. The angled stop or lock projection 36*b* and recess 38*b* of FIG. 12B, however, permit only 180° of rotation of the panel 28***b* relative to frame 24*b* owing to positive interfering engagement of the vertical faces of the projection and recess. The projection 36*c* and recess 38*c* of FIG. 12C afford one-time locking action, permanently securing the panel 28*c* in the FIG. 2 position (relative to frame 24*c*) once it has been initially rotated from the display position of FIG. 5, and thereby preventing accidental dislodgment and misorientation of the panel by the user.

Figure 13:
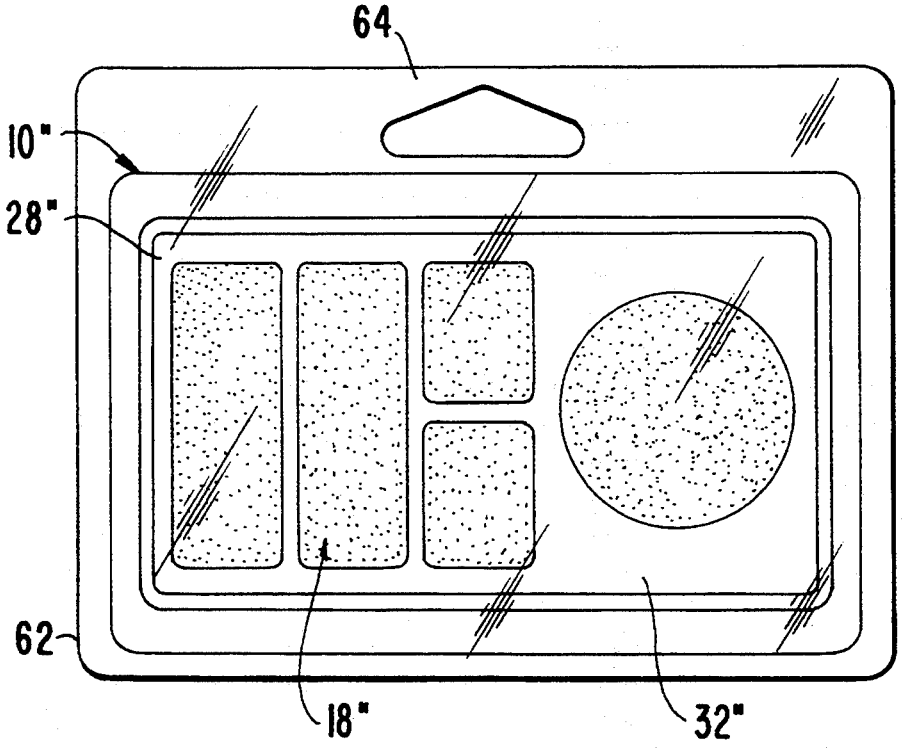
FIG. 13 is a front elevational view of a blister package containing a compact embodying the invention.
Figure 14:
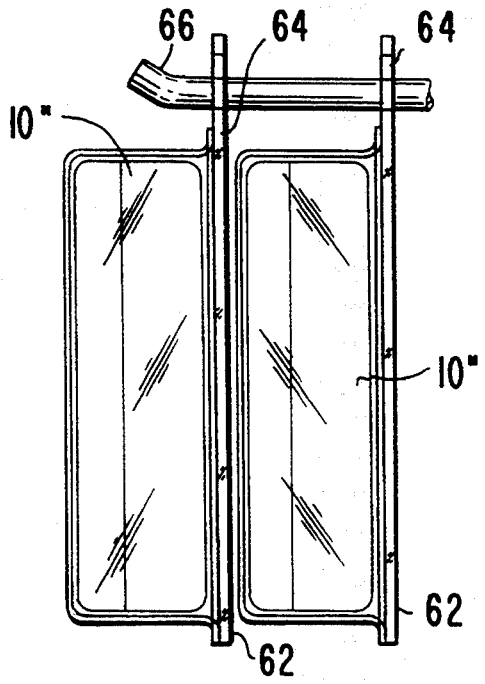
FIG. 14 is a side elevational view of two of the blister packages of FIG. 13 on a store rack.

The advantages of the invention with respect to minimization of retail display space will be apparent from FIGS. 13 and 14. As there shown, a compact 10" embodying the invention (and essentially identical to compact 10 of FIGS. 1–9, except that it has a different number of cosmetics-holding recesses 18" in the base panel 28") is sealed in a transparent blister package 62 with the tray face 32" of panel 28" exposed to the exterior and the compact fully closed, i.e., in the same arrangement as that shown in FIG. 5 for compact 10. The area occupied by the package, therefore, is simply that of the closed compact, together with the package margin or rim 64. An array of such packages may be suspended vertically on a display rack or rod 66 in a store, enabling prospective purchasers to view the contained cosmetics without opening the compacts and exposing the contents thereof.

In contrast, in the case of a conventional compact, similar packaging to permit viewing of protectively shielded contents would require that the blister-packaged compact be open 180° as in FIG. 10, occupying an area equal to twice that of the closed compact, exclusive of the package rim. Such an arrangement would virtually double the face area of a displayed package, and correspondingly reduce by almost half the number or diversity of packages capable of side-by-side display in a given space, i.e., as compared to the packaged compact of the invention shown in FIGS. 13–14.

Figure 15:
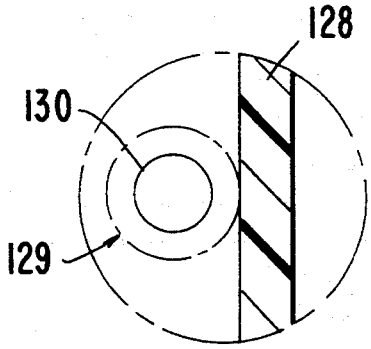
FIG. 15 is an enlarged fragmentary sectional view in illustration of certain features of illustrative or exemplary types of pivot arrangements useful with the invention.

While the two opposed flush positions of the base and/or cover panels offer the advantages as described above, in some instances intermediate panel positions may be useful, or beneficial from the standpoint of novelty of product design. Such positions may include those represented in FIG. 4 and in broken lines in FIG. 11. To retain a panel 128 at a particular intermediate angle (or at any of a selection of particular angles) relative to its associated frame, cooperating detent means may be formed (for example) on the facing side edges of the panel and frame in a region 129 around the point 130 of pivoting of the panel as illustrated diagrammatically in FIG. 15. Again, FIG. 15 is merely illustrative or exemplary of such features of the invention.

Figure 16:
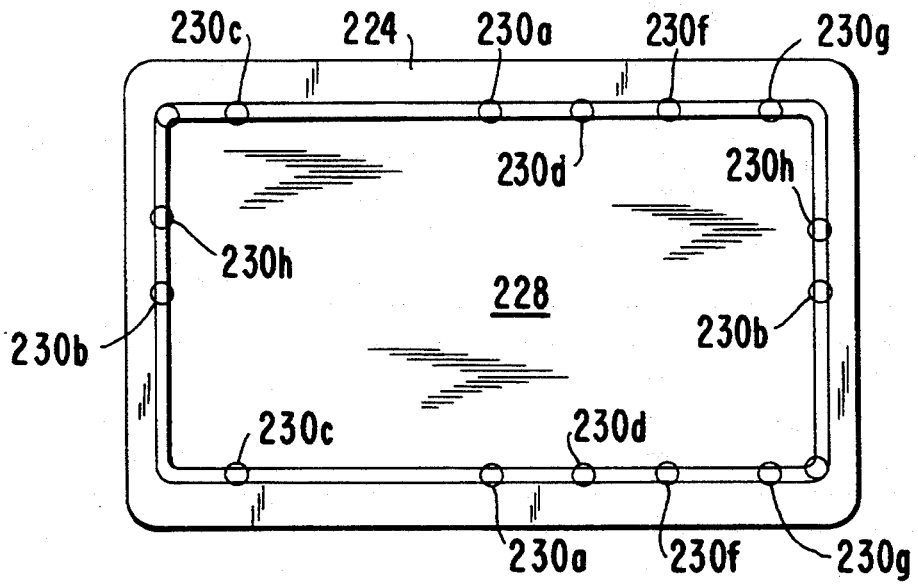
FIG. 16 is a plan view of a compact embodying the invention, illustrating various possible pivot points.
Figure 17:
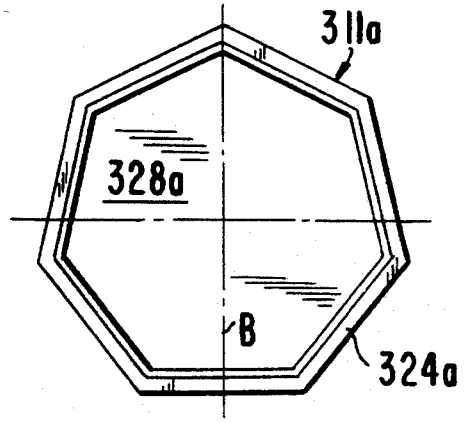
FIGS. 17–21 are plan views of illustrative or exemplary alternative configurations of compacts in which the invention may be embodied.
Figure 18:
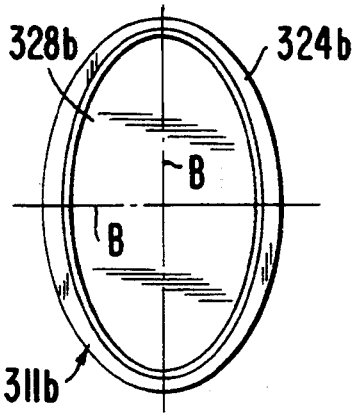
Figure 19:
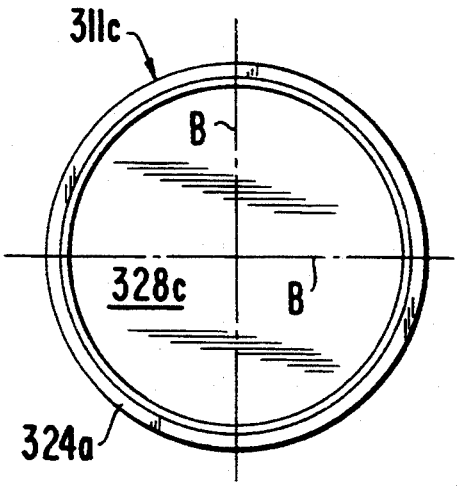
Figure 20:
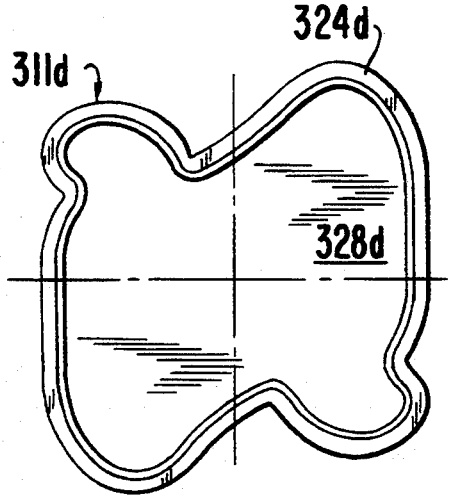
Figure 21:
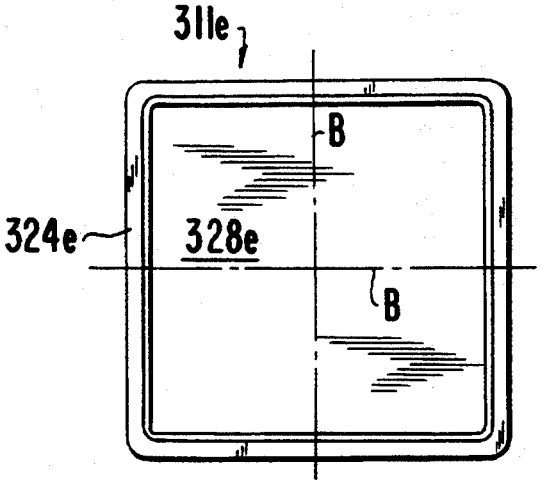

Indeed, in some useful compacts having a base and/or a cover member comprising a peripheral frame and a central platform or panel rotatably mounted therein, the rotating base or cover panel may have only a single position in which it lies flush with its associated frame, viz. (in the case of a base panel) the first or closed position shown in FIGS. 2 and 3, while also having one or more detent positions in which it is oriented at an oblique angle to the frame (again as in FIG. 4 and in the broken-line showings of FIG. 11). Where only a single flush position of the panel relative to the frame is provided, it is not necessary that the axis of rotation of the panel relative to the frame coincide with an axis of bilateral symmetry of the panel and frame opening; instead, the points of pivotal connection of the panel to the frame (and the axis of rotation they define) may be located virtually anywhere around the frame and panel, as indicated diagrammatically in FIG. 16 (for the case of a rectangular-plan compact base member comprising a frame 224 and a panel 228) by exemplary pairs of pivot points 230*a*–230*h*, in which pivot points with the same designation cooperatively define a particular rotational axes, and only the axes defined by points 230*a* and 230*b* coincide with an axis of symmetry of the panel and frame opening. The points shown in FIG. 16 are illustrative only of the unlimited variation of possible locations of such pivot points.

Compacts embodying the invention are not limited to rectangular-plan configurations. Other exemplary configurations are shown in FIGS. 17–21. One more, these are merely illustrative of the virtually infinite variety of compact shapes in which the invention may be embodied. To provide a compact base and/or cover member in which a rotating panel (e.g. 328*a, b, c* or *e*) has two opposed flush positions relative to the frame (e.g. 324 a, b, c or e), the panel and frame opening must be bilaterally symmetrical about at least one axis, and the location of the pivot points must define a rotational axis coincident with an axis of symmetry. Examples of such configurations a regular polygonal base 311*a* (FIG. 17), an oval base 311*b* (FIG. 18), a circular base 311*c* (FIG. 19) and a square base 311*e* (FIG. 21), in which axes of bilateral symmetry are indicated by lines B. Additional, irregular configurations (as represented by base 311*d* including frame 324*d* and panel 328*d*, in FIG. 20) may be used if only a single flush position is required. In still further embodiments of the invention (not shown), a base or cover member of a compact may include a frame with two or more openings, having a rotating panel mounted in each of these openings It is to be understood that the invention is not limited to the features and embodiments hereinabove specifically set forth, but may be carried out in other ways without departure from its spirit.

What is claimed is:

1. A compact for containing cosmetics, having an exterior and an interior and including a base member, a cover member, and means for connecting the base and cover members together in a manner permitting relative movement of the members to open and close the compact, wherein said base member comprises (a) a frame, exposed to the exterior of the compact when the compact is closed, defining and completely laterally surrounding at least one through opening;

(b) at least one panel, said one panel having opposed major faces and being shaped and dimensioned to be received within said one opening in substantially flush relation to the frame, one of said major faces of said one panel being formed as a tray for holding cosmetic material to be contained in the compact; and (c) means for pivotally mounting said one panel to the frame for rotation within said one opening, relative to the frame, about an axis extending across said one opening, into and out of at least one position in which said one panel lies substantially flush with the frame and one of said major faces is exposed to the exterior of the compact when the compact is closed.

2. A compact as defined in claim 1, wherein said base member includes means for retaining said one panel in said one position relative to the frame.

3. A compact as defined in claim 2, wherein said retaining means comprises a projection on one of said frame and said one panel and a portion of the other of said frame and said one panel shaped and positioned to engage said projection when said panel is in said one position relative to the frame.

4. A compact as defined in claim 2, wherein said one panel is shaped and dimensioned to be rotatable about said axis, relative to the frame, through at least 180°, between said one position and a second position in which said one panel lies substantially flush with the frame and the other of said major faces is exposed to the exterior of the compact when the compact is closed; and wherein said mounting means comprises means for pivotally mounting said one panel for rotation about said axis between said one position and said second position, such that in said one position and said second position said tray is respectively oriented toward the interior of the compact and exposed to the exterior of the compact, said compact being closable when said one panel is in either of said positions.

5. A compact as defined in claim 4, wherein said retaining means comprises means for releasably holding said one panel in each of said one position and said second position relative to the frame.

6. A compact for containing cosmetics, having an exterior and an interior and including a base member, a cover member, and means for hingedly connecting the base and cover members together at one side of the compact for relative pivotal movement of the members to open and close the compact, wherein said base member comprises (a) a frame secured to the connecting means, exposed to the exterior of the compact when the compact is closed, and defining and completely laterally surrounding a through opening which is bilaterally symmetrical about at least one axis;

(b) a panel, having opposed major faces, conforming in shape to and dimensioned to be received within and substantially fill said opening in substantially flush relation to the frame, one of said major faces being formed as a tray for holding cosmetic material; and (c) means for pivotally mounting said panel to the frame for rotation within said opening, relative to the frame, through at least 180° about said axis between first and second positions in both of which said panel lies substantially flush with the frame, and in which, respectively, said tray is oriented toward the interior of the compact and is exposed to the exterior of the compact when the compact is closed, said compact being closable when said panel is in either of said positions.

7. A compact as defined in claim 6, including means for releasably retaining said panel in each of said first and second positions relative to the frame.

8. A compact as defined in claim 6, wherein said cover member comprises (a) a frame secured to the connecting means, exposed to the exterior of the compact when the compact is closed, and defining and completely laterally surrounding a through opening which is bilaterally symmetrical about at least one axis;

(b) a panel, having opposed major faces at least one of which bears a mirror, conforming in shape to and dimensioned to be received within and substantially fill said through opening of said frame of said cover member in substantially flush relation to said frame of said cover member; and (c) means for pivotally mounting said panel of said cover member to the frame of said cover member for rotation within said through opening of said frame of said cover member, relative to said frame of said cover member, through at least 180° about said one axis of bilateral symmetry of said through opening of said frame of said cover member between first and second positions in both of which said panel of said cover member lies substantially flush with said frame of said cover member, and in which, respectively, said mirror is oriented toward the interior of the compact and is exposed to the exterior of the compact when the compact is closed, said compact being closable when said panel of said cover member is in either of said first and second positions in which said panel of said cover member lies substantially flush with said frame of said cover member.

9. A compact as defined in claim 8, including means for releasably retaining said panel of said cover member in each of said first and second positions in which said panel of said cover member lies substantially flush with said frame of said cover member.

10. A compact for containing cosmetics, having an exterior and an interior and including a base member, a cover member, and means for connecting the base and cover members together in a manner permitting relative movement of the members to open and close the compact, wherein each of said members comprises (a) a frame, exposed to the exterior of the compact when the compact is closed, defining and completely laterally surrounding at least one through opening;

(b) at least one panel, said one panel having opposed major faces and being shaped and dimensioned to be received within said one opening in substantially flush relation to the frame;

(c) means for pivotally mounting said one panel to the frame for rotation within said one opening, relative to the frame, about an axis extending across said one opening, into and out of at least one position in which said one panel lies substantially flush with the frame and one of said major faces is exposed to the exterior of the compact when the compact is closed; and (d) means for retaining said one panel in said one position relative to the frame;

(e) one of said major faces of said one panel of the base member being formed as a tray for holding cosmetic material.

11. A compact as defined in claim 10, wherein at least one of said major faces of said one panel of the cover member bears a mirror.

* * * * *